United States Patent [19]

Henery et al.

[11] Patent Number: 4,466,361

[45] Date of Patent: Aug. 21, 1984

[54] METHOD AND APPARATUS FOR WASTE INCINERATION

[75] Inventors: Maurice D. Henery, Evanston; John M. Kerwin, Flossmoor; Walter W. Walker, Matteson, all of Ill.

[73] Assignee: Marblehead Lime Company, Chicago, Ill.

[21] Appl. No.: 498,598

[22] Filed: May 26, 1983

[51] Int. Cl.[3] ..... F23G 5/06

[52] U.S. Cl. ..... 110/346; 110/210; 110/217; 110/219; 110/246; 110/342; 110/345; 110/347; 432/106

[58] Field of Search ..... 110/210, 212, 213, 215, 110/216, 217, 237, 238, 246, 257, 261, 262, 264, 297, 301, 341, 342, 346; 432/103, 108, 13, 14, 106

[56] References Cited

U.S. PATENT DOCUMENTS

| | | | |
|---|---|---|---|
| 2,501,977 | 3/1950 | Wallerstedt et al. | 110/346 |
| 3,166,302 | 1/1965 | Klesper | 110/346 |
| 3,716,002 | 2/1973 | Porter et al. | 110/212 |
| 4,173,190 | 11/1979 | Greenberg et al. | 110/346 |
| 4,245,571 | 1/1981 | Przewalski | 110/212 |
| 4,276,835 | 7/1981 | Zeltner | 110/216 |
| 4,320,709 | 3/1982 | Hladyn | 110/212 |
| 4,377,978 | 3/1983 | Eusner | 110/262 |

*Primary Examiner*—Edward G. Favors
*Assistant Examiner*—Steven E. Warner
*Attorney, Agent, or Firm*—McDougall, Hersh & Scott

[57] ABSTRACT

A system including a method and apparatus for incinerating toxic and non-toxic waste materials. The system involves the use of a pre-treatment agent which is capable of insuring flowability in the waste materials to be incinerated. The agent is mixed with the material and then introduced to a rotary kiln which is fired to a temperature such that incineration of the material will occur by providing a satisfactory rate of material flow through the kiln. The kiln includes a rotary scoop feeder which is utilized for introducing the mixture of material and agent into a hot zone of the kiln. An afterburner may be utilized for decomposing materials such as hazardous organic wastes, and the output of the apparatus may be associated with a baghouse.

11 Claims, 2 Drawing Figures

METHOD AND APPARATUS FOR WASTE INCINERATION

BACKGROUND OF THE INVENTION

The invention is particularly concerned with a system for the handling of toxic and non-toxic waste materials. The invention comprises a method and apparatus which involve the use of a rotary kiln with the waste material being incinerated as it moves through the kiln.

Various attempts have been made to dispose of waste materials through the use of incinerators. Such attempts have included rotary kilns or furnaces of a similar nature, and reference is made to Wheildon U.S. Pat. No. 723,959; Duerp, et al. U.S. Pat. No. 2,212,062; Wallerstedt, et al. U.S. Pat. No. 2,501,977; Zinn U.S. Pat. No. 3,436,061; Lerner, et al. U.S. Pat. No. 3,584,609; and Koyanagi U.S. Pat. No. 3,861,336 as illustrative of such prior attempts.

Although disposal of waste materials with systems of the type described in the prior art has been satisfactory to some extent, severe problems had not been solved. These problems relate to the fact that waste accumulates at a rate which is difficult to control so that there is a constant need for more efficient systems for waste disposal. Furthermore, hazardous wastes have recently become much more significant problems, and effective means for disposing of wastes of this type are particularly desirable.

SUMMARY OF THE INVENTION

The system of the present invention comprises a process and apparatus which will achieve efficient incineration of both toxic and non-toxic wastes. The process and apparatus are particularly useful in instances where large amounts of wastes must be handled on a substantially continuous basis.

The process particularly involves the incineration of toxic and non-toxic waste materials through the utilization of a rotary kiln. The materials to be incinerated are first mixed with a pre-treatment agent which is capable of insuring flowability of the material. The kiln is fired, and the mixture of the agent and material is introduced to a hot zone of the kiln by means of a rotary scoop feeder. Continuous introduction of the mixture and continuous removal of the incinerated mixture provides a highly efficient and effective system for treatment of the waste material leading to ultimate disposal.

DESCRIPTION OF SPECIFIC EMBODIMENT

Figure 1:
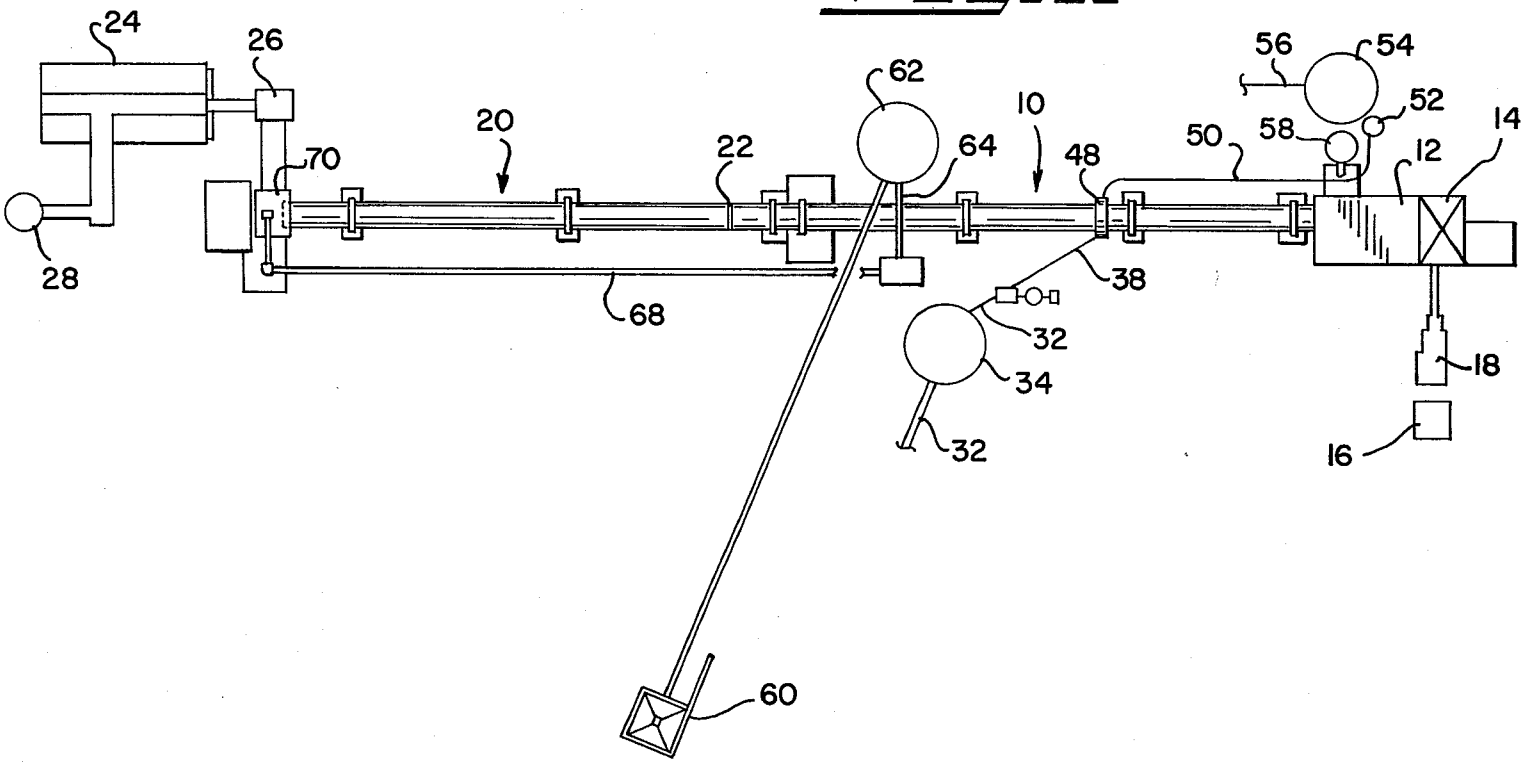
FIG. 1 comprises a plan view of a rotary kiln and associated mechanisms of the type contemplated by this invention; and, FIG. 2 is an enlarged fragmentary plan view of the kiln section with rotary scoop feeder.

The construction illustrated in FIG. 1 comprises a kiln including section 10 mounted for rotation in a conventional fashion. The kiln includes a discharge end terminating at burner building 12. The burner building may, for example, include a coal burner 14 of conventional type with a coal hopper 16 providing coal for feeder 18.

In accordance with one form of the invention, the kiln includes an afterburner section 20 which is connected to the rotary section 10 by means of rotary seal 22. The afterburner section may be held stationary in an arrangement of this type, and gases from the afterburner are adapted to be discharged into baghouse 24. An induced draft fan 26 is provided for drawing the gases into the baghouse, and stack 28 is provided for removal of gases which have passed through the filter bags.

A hopper or other such means (not shown) may be provided for feeding waste material onto conveyor 32 for delivery to the kiln. In the embodiment shown, a sludge tank 34 is provided in the line between the hopper and the kiln, and additional conveyor 38 is provided for delivering this waste to the rotary section 10 of the kiln. Where a sludge tank is not involved, the conveyor 32 may be employed for delivering waste directly to conveyor 38.

Figure 2:
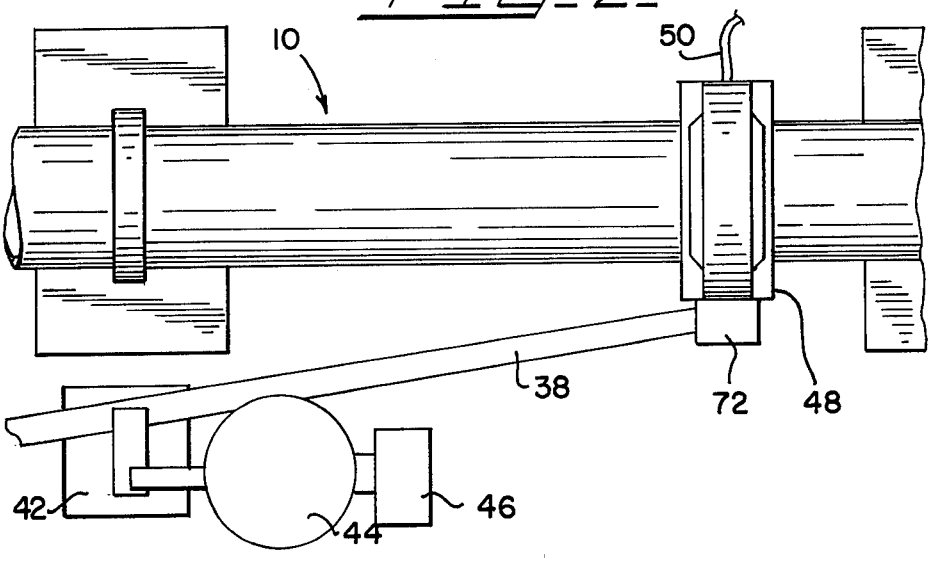

The system contemplates the use of a pug mill 42 which, as best shown in FIG. 2, is connected to coal tank 44 and hopper 46. With this arrangement, coal fines and/or coke breeze or the like may be added to the waste as it is being delivered to the rotary section 10 of the kiln.

The invention contemplates the provision of a rotary scoop feeder 48 for receiving the waste and for delivering the waste to the interior of the kiln. Such feeders may, for example, be of the general type manufactured by Fuller Company for use in connection with limestone kilns.

A feed line 50 is connected to the scoop feeder 48, and the tank 52 is adapted to feed material through line 50 into the scoop feeder. In accordance with this invention, the material fed through the line 50 comprises an agent capable of insuring flowability in the waste material to be incinerated. Thus, the invention contemplates the use of the scoop feeder 48 for achieving mixing of this agent with the waste material.

An additional tank 54 is provided for purposes of delivering waste into the kiln. This tank is particularly contemplated for use in storing hazardous organic wastes which can be metered into the kiln through line 56 in appropriate amounts for decomposition.

In the operation of the system illustrated, the burner 14 will provide heat of a suitable amount for achieving incineration of waste delivered to the kiln section 10. The heating of the kiln is such that the zone in the area of the scoop feeder 48 comprises a hot zone. Accordingly, material fed into the kiln is delivered directly into a zone of sufficient temperature to achieve initial incineration.

As indicated, the waste material is mixed in the scoop feeder with an agent introduced through line 50. A preferred agent for this purpose comprises lime flue dust which is added in amounts sufficient to provide suitable flowability for the waste material. It will be appreciated that the amount of agent to be added must be determined by considering the characteristics of the waste material. Since the invention contemplates all types of waste material including sludge, the proportions of agent will vary widely and can only be determined after inspecting the character of the waste material. The reference to "flowability" is to be construed as the ability of the waste material to be handled by the scoop feeder and to move within the kiln as incineration progresses.

The incineration of the waste material leads to the formation of clinker which will be discharged at the burner end in accordance with standard rotary kiln operation. A tank 58 is provided for collecting clinker in accordance with such standard practice.

The incineration of the waste will also lead to the formation of gases which are discharged at the opposite end of the kiln. In a typical system, a baghouse 24 will be required to insure that particulates are not discharged into the atmosphere. Where lime flue dust is employed as the agent, the dust will serve the additional function of acting as a precoat on the baghouse filter bags. Thus, in addition to coating the sludge or other waste material to improve flowability, the particles of dust carried with the gases to the baghouse will achieve an improvement in the function of the filter bags in the baghouse.

The kiln operates under negative pressure since the induced draft fan 26 draws all gases toward the baghouse 24. There is no tendency for any gases to escape through kiln openings and therefore no danger that toxic gases will be released to the atmosphere. In this same connection, the conveyors 32 and 38 preferably comprise a screw conveyor or some other type of enclosed conveyor structure. A housing 72 is preferably provided at the juncture of the conveyor end, and the rotary scoop feeder 48 so that the waste being handled will be confined at all times. The negative pressure generated by the induced draft fan 26 can also prevail in these other areas of the system, and this is particularly advantageous for odor control. Thus, openings in such conveyors, in the scoop feeder, etc., will not allow gases to be released, but instead, the gases will be maintained within the system.

The system of the invention envisions the use of a variety of fuels for firing the kiln. In addition to coal, natural gas, oil, waste industrial solvents and shredded solid wastes are examples of fuels which may be used individually or in combination. It will also be understood that fuel values of significant amounts are often contained in waste materials and, therefore, the amount of independent fuel necessary for firing the kiln can be reduced accordingly. Liquid industrial wastes and solvents are examples of waste materials containing significant fuel values.

The heat generated by the kiln may also be utilized in connection with a boiler for generating electrical power or in connection with heating systems for buildings, etc.

In addition to taking advantage of fuel values in the waste material, the addition of the coal fines discussed above will increase the fuel value of the waste material whereby the fines can be disposed of while serving a useful purpose. The use of the coal fines is particularly advantageous where sludge is involved since the fines will also tend to increase the flowability of the sludge.

Oxygen may also be introduced in the system for purposes of decreasing the amount of excess air required. The use of the oxygen will thus decrease the amount of fuel consumed to achieve incineration.

In a typical application of the invention, dewatered sludge containing about 26 percent solids and having an ash content of 40 percent on a dry basis is introduced in the system by means of conveyors 32, 36 and 38. Lime flue dust in a proportion of about 100 pounds per ton of sludge was introduced into a scoop feeder 48.

The burner is operated to achieve a temperature in the zone of the scoop feeder of about 2000° F. The kiln was operated to provide a dwell time for solids of approximately 50 minutes as the solids move from the point of introduction to the discharge end. As earlier indicated, the foregoing simply provides a typical example since the nature of the sludge or other waste material, and the proportion of flowability agent used will vary widely.

Where the systems of the inventions are utilized in connection with hazardous organic waste, the afterburner section 20 becomes particularly useful. This section is preferably fixed against rotation, and is heated by auxiliary burners for purposes of decomposing the hazardous waste material. Such decomposition can take place in a matter of fractions of seconds where sufficiently high temperatures are employed. The temperatures employed and the length of exposure at such temperatures will vary depending on the types of wastes being treated.

A typical kiln for use in the practice of the invention will have a diameter in the order of 12 feet and a length in the order of 400 feet. It is contemplated that the rotary scoop feeder will be located from 80–100 feet from the burner end of the kiln with a temperature of 2000° F. or higher being achievable at this point. Gases from this initial burning would flow into the afterburner section whereby the gases will travel 300 feet or more at temperatures in the order of 1500° F. for at least half this distance and prior to being introduced to the baghouse. It will be understood that an electrosttic precipitator, wet scrubber or similar device may be used alone in conjunction with other devices, such as the baghouse, for achieving cleaning of the exhaust gases.

In some instances, it becomes desirable to introduce limestone as a further additive in the system to control the acidity of the clinker, neutralize $SO_2$ emissions, and possibly to provide hydraulic cement clinker to facilitate disposal. The limestone may be introduced from hopper 60 to sludge tank 62 and then by means of conveyors 64 and 68 to the end 70 of kiln section 20. Where the option is used, the section 20 is also rotated so that the stone will be fed along the entire length of the kiln.

The apparatus of the invention could be built specifically for the purposes described. On the other hand, a valuable feature of the invention relates to the fact that rotary kilns utilized for handling of limestone can be easily adapted for the practice of the invention. This provides a particularly advantageous arrangement since those faced with waste disposal problems can avoid large capital investments by utilizing an existing kiln while providing a highly efficient means for eliminating the waste problem.

It will be understood that various changes and modifications may be made in the above-described construction which provide the characteristics of the invention particularly as defined in the following claims.

We claim:

1. A method for incinerating toxic and non-toxic waste materials comprising the steps of providing a pretreatment agent capable of insuring flowability in the material to be incinerated, mixing said agent with said material, providing a rotary kiln, firing said kiln, providing a rotary scoop feeder for said kiln, mixing of said agent with said material being accomplished by introducing said agent to said rotary scoop feeder whereby the agent is mixed with said waste material in said feeder, introducing the mixture of waste material and agent into a hot zone of said kiln by means of said feeder whereby the mixture is delivered directly into a zone of sufficient temperture to achieve initial incineration and whereby the incineration is completed as the mixture progresses to a discharge end of the kiln where an incinerated mixture is achieved, and removing the incinerated mixture from the kiln.

2. A method in accordance with claim 1 including the step of providing a baghouse including filter bags, the gases passing from said kiln to said baghouse including material adapted to pre-coat said filter bags for improving the efficiency of the baghouse operation.

3. A method in accordance with claim 2 wherein said agent includes lime flue dust.

4. A method in accordance with claim 3 wherein said waste material comprises sewage sludge.

5. A method in accordance with claim 1 wherein coal fines are added to said sludge prior to introduction of the sludge to said kiln.

6. A method in accordance with claim 1 including the step of adding oxygen to the waste material prior to introduction into said kiln.

7. A method in accordance with claim 1 including an afterburner, and including the step of passing gases generated by said incinerator into said afterburner.

8. A method in accordance with claim 7 wherein said gases include hazardous organic wastes which are adapted to be decomposed in said afterburner.

9. An apparatus for incinerating toxic and non-toxic waste materials including a rotary kiln, means for firing said kiln, a feeder associated with said kiln, means for providing a pre-treatment agent capable of insuring flowability in the material to be incinerated, means for preparing a mixture of said agent and said material comprising a conveyor extending to said feeder, said conveyor providing means for delivering said material to said feeder, and including separate means for delivering said agent to said feeder whereby the mixture of the agent and waste material is achieved in said feeder, means including said feeder for delivering said mixture of said material and said agent into a hot zone of said kiln, means for removing incinerated mixture from the kiln, and an afterburner connected to said kiln for receiving gaseous discharge from the kiln.

10. An apparatus in accordance with claim 9 wherein said feeder comprises a rotary scoop feeder.

11. An apparatus in accordance with claim 9 including a baghouse for receiving discharge from said afterburner.

* * * * *